United States Patent [19]

Mosehauer et al.

[11] Patent Number: 5,001,028

[45] Date of Patent: Mar. 19, 1991

[54] ELECTROPHOTOGRAPHIC METHOD USING HARD MAGNETIC CARRIER PARTICLES

[75] Inventors: Michael Mosehauer, Rochester; Yee S. Ng, Fairport; Eric K. Zeise, Pittsford, all of N.Y.

[73] Assignee: Eastman Kodak Company, Rochester, N.Y.

[21] Appl. No.: 386,381

[22] Filed: Jul. 28, 1989

Related U.S. Application Data

[63] Continuation-in-part of Ser. No. 232,073, Aug. 15, 1988.

[51] Int. Cl.[5] ..... G03G 13/01; G03G 13/09

[52] U.S. Cl. ..... 430/45; 430/122

[58] Field of Search ..... 430/45, 54, 102, 120, 430/122

[56] References Cited

U.S. PATENT DOCUMENTS

| | | | |
|---|---|---|---|
| 4,191,465 | 3/1980 | Boase et al. | 355/3 SH |
| 4,194,829 | 3/1980 | Cavagnaro | 355/3 TR |
| 4,308,821 | 1/1982 | Matsumoto et al. | 118/658 X |
| 4,309,498 | 1/1982 | Yamashita et al. | 430/122 X |
| 4,473,029 | 9/1984 | Fritz et al. | 118/657 |
| 4,531,832 | 7/1985 | Kroll et al. | 355/3 DD |
| 4,546,060 | 10/1985 | Miskinis et al. | 430/108 |
| 4,599,285 | 7/1986 | Haneda et al. | 430/54 |
| 4,629,669 | 12/1986 | Shoji et al. | 430/47 |
| 4,637,973 | 1/1987 | Shigeta et al. | 430/122 |
| 4,731,634 | 3/1988 | Stark | 355/3 TR |

FOREIGN PATENT DOCUMENTS

| | | | |
|---|---|---|---|
| 0066141 | 12/1982 | European Pat. Off. | 430/45 |
| 0240888 | of 1987 | European Pat. Off. . | |
| 0251816 | of 1987 | European Pat. Off. . | |
| 0263501 | of 1987 | European Pat. Off. . | |
| 56-144452 | of 1981 | Japan . | |

*Primary Examiner*—Roland E. Martin

*Attorney, Agent, or Firm*—Leonard W. Treash, Jr.

[57] ABSTRACT

A multicolor reproduction is made by uniformly charging a photoconductive member, imagewise exposing that member to create a first electrostatic image, developing the first electrostatic image with a toner of a first color to create a first toner image, preferably uniformly recharging the photoconductive member, imagewise exposing the charged member creating a second electrostatic image, developing the second electrostatic image by the application of toner of a second color to the exposed areas. The process can be repeated for any number of colors. The multicolor image is then transferred in a single step to a receiving sheet. The second and subsequent development steps are carried out by a magnetic brush developing device employing hard magnetic carrier particles that are tumbled through a development zone which tumbling does not adversely affect the prior toner images. Preferably the hard magnetic carrier particles have a coercivity of at least 100 gauss when magnetically saturated, but more preferably a coercivity of at least 1000 gauss when magnetically saturated.

18 Claims, 4 Drawing Sheets

ELECTROPHOTOGRAPHIC METHOD USING HARD MAGNETIC CARRIER PARTICLES

This is a continuation-in-part of our earlier filed U.S. patent application Ser. No. 232,073 filed on Aug. 15, 1988.

TECHNICAL FIELD

This invention relates to color electrophotography and more specifically to a method of forming a multicolor image on the same frame or area of a photoconductive member, so that it may be transferred or otherwise utilized in a single step.

BACKGROUND ART

U.S. Pat. No. 3,057,720 suggests that two color toner images can be formed consecutively on the same image frame without fixing the first image if the second toning step is not so harsh as to clean off the first toner image. Three color systems are disclosed using either positive development or discharged area development. A variety of development methods are suggested.

Japanese Kokai 56-144452 (1981) also discloses a process in which two or three color toner images are formed on the same frame of a photoconductive member. As disclosed, the photoconductive member is uniformly charged, exposed and reverse developed with a toner of a first color. With the unfixed toner electrostatically adhering to the exposed areas the photoconductive member is exposed to a second image that does not overlap with the first image. That image is then developed by application of a second color toner to the newly exposed areas. The process can be repeated for more colors. The resulting multicolor image is transferred to a receiving sheet in one step.

These processes can be set up to double the speed of prior two color processes in which separate images are made on separate frames and then transferred in registration. Further, the required registration of the exposing steps is far easier to accomplish with accuracy than is registration in the transfer step.

However, this process has an inherent problem when used with conventional magnetic brush systems that the second and subsequent toning steps have a tendency to scrape or brush off the toner applied in the earlier toning steps. The above disclosure is representative of many which suggest the only way to solve this problem is to leave a gap between the brush and the image. By any of a number of approaches suggested in the prior art the toner (from both mono-component and dual-component developer) is propelled or projected across the gap to develop the electrostatic image without brushing off the prior formed toner images. See U.S. Pat. No. 4,629,669; European Patent Application No. 0240888; European Patent Application No. 0066141; U.S. Pat. No. 4,599,285 and U.S. Pat. No. 3,775,106.

However, projection toning brings its own set of problems to the system. The most serious is a difficulty in doing high density toning at reasonably fast machine speeds. Also, the gap between toner and image is critical and must be maintained. Toners usable in the process are limited, limiting the colors available; especially difficult to use in this process are those of lighter hue, such as yellow. It is a difficult process to establish a background controlling electrical field.

U.S. Pat. Nos. 4,546,060; 4,473,029 and 4,531,832 describe a method of toning in which a magnetic brush applicator supplies two component developer including small hard magnetic carrier particles and electrically insulative toner to an image which moves past the development station at a predetermined velocity. The brush includes a rapidly rotating core which tumbles the hard carrier particles through a development zone. The tumbling of the carrier is apparently due to the changing magnetic field which continuously flips the carrier. This process has a number of advantages in image quality, and is being used commercially.

DISCLOSURE OF THE INVENTION

It is an object of the invention to provide a method of developing an electrostatic image on an image area, which image area already contains a first toner image without substantially disturbing the first toner image.

It is another object of the invention to provide a method for making multicolor reproductions using a single frame or area of a photoconductive member which method generally uses a two component developer for creating at least the second of two toner images in said area, but in which toning of the second image does not materially disturb the first toner image and in which no gap need be maintained between the developer and the image with the attendant disadvantages thereof.

We have discovered that while prior magnetic brushes in which the developer contacts the image has a tendency to clean off the prior toner images while developing the electrostatic image, the development process disclosed in U.S. Pat. Nos. 4,546,060; 4,473,029 and 4,531,832 provide high density images at good speed without substantial damage to the prior toner images.

According to a preferred embodiment the developer is transported through the development zone by rotating an alternating-pole magnetic core within a non-magnetic shell upon which shell the developer flows through said zone, and the developer includes hard magnetic carrier particles that are sufficiently hard that they flip or tumble as they pass through the development zone.

Prior magnetic brushes typically include soft magnetic carrier, for example, carrier that has a coercivity substantially less than 100 gauss. As such particles are subjected to a changing magnetic field their magnetism changes with the field. This permits a brush to transport the carrier in the form of long relatively static bristles through the development zone. To apply substantial toner at medium speed, the brush generally requires relative motion with respect to the electrostatic image, commonly obtained by rotating a non-magnetic sleeve in a direction opposite to the direction of the image. The bristles have a tendency to brush at least portions of any prior toner image off the image area.

The invention disclosed in the patents cited above to Miskinis et al, Kroll et al, and Fritz et al, uses hard magnetic carrier particles which do not adapt magnetically to a changing field. Rather they are flipped or tumbled by the changing field. Without intending to be limited to any technical theory of operation, it is believed that the remarkable results obtained herein are because excellent development can be obtained with these tumbling, magnetically hard carrier particles without creating bristles in the development zone that have a tendency to clean off the image. The bristles, as mentioned, generally require substantial relative movement for reasonable speed and density development, while this system works best with little or no relative movement between the overall body of developer and the image.

BRIEF DESCRIPTION OF THE DRAWINGS

In the detailed description of the preferred embodiment of the invention presented below reference is made to the accompanying drawings, in which.

BEST MODE OF CARRYING OUT THE INVENTION

The invention can be used in a variety of electrophotographic applications. It will be described with regard to an electronic printer.

Figure 1:
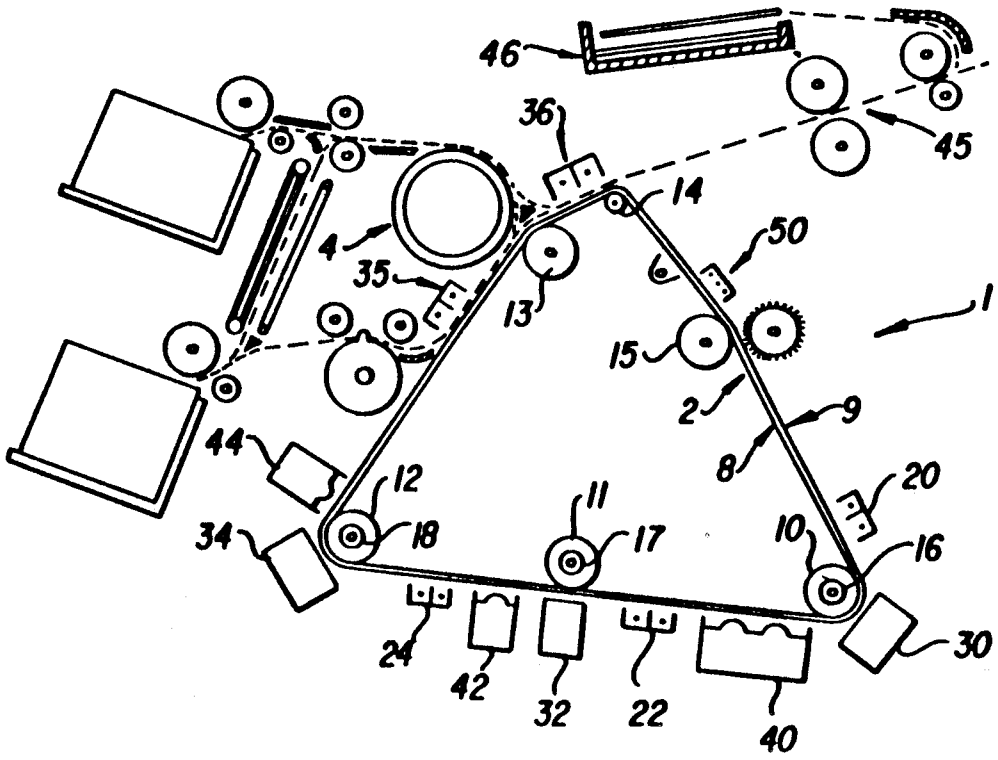
FIG. 1 is a schematic side illustration of an electrophotographic printer utilizing the invention.

According to FIG. 1 an electronic printer 1 includes a photoconductive member, for example, photoconductive web 2 entrained about a series of rollers 10, 11, 12, 13, 14 and 15. The photoconductive web 2 is a multilayer structure which can take various forms, but is commonly a photoconductive layer 9 on a conductive backing 8 with a suitable support. The web 2 is driven by one of the rollers at a constant velocity through operative relationship with a series of electrophotographic stations.

A first charging station 20 imparts a uniform charge to an image area of the photoconductive surface on the web 2 which charge may be of either polarity depending on the characteristics of the photoconductive web. The uniformly charged image area is then exposed at a first electronic exposure station 30 to dissipate the charge creating a first electrostatic image. The electronic exposure station 30 can be any known device which converts electrical signals into a light image, for example, a scanning laser or an LED printhead. An optical exposure, for example, by flash or optical scanning, can also be used. The first electrostatic image is toned at a first development station 40 by the application of finely-divided marking particles which are charged to the same polarity as the original charge placed on the web by first charging station 20 to thereby tone the areas of the web that are discharged by exposure at the first electronic exposing station 30 to create a first toner image of a first color, for example, black.

The same image area of the web then passes into operative relation with a second charging station 22 which essentially repeats the process of the first charging station, uniformly charging the web to a polarity the same as the polarity imparted by first charging station 20. The uniformly charged photoconductive member 2 is now imagewise exposed at second electronic exposure station 32 to create a second electrostatic image by imagewise discharging the photoconductor. The second electrostatic image is then toned at second development station 42 by the application again of finely-divided toner of a second color having a charge the same as the uniform charge placed on the photoconductive member at second charging station 22 to create a second toner image of a second color, for example, red.

The process is then repeated using a third charging station 24 to lay down a uniform charge, a third electronic exposure station 34 to create a third electrostatic image and third development station 44 to create a third toner image of a different color, for example, blue.

At this stage in the process, a single frame or image area on the photoconductive member contains three distinct color images, i.e., a multicolor toner image. A fourth set of stations could create a fourth color in the same way.

The multicolor image is then transferred to a copy sheet at first transfer station 35. In the preferred embodiment shown in FIG. 1 the same process is repeated for the next frame resulting in another multicolor toner image. The copy sheet is inverted using a turnaround drum 4 and the second multicolor toner image is transferred to the side opposite that receiving the first multicolor toner image at second transfer station 36. The copy sheet is then fed without disturbing the toner images to a fuser 45 which fixes both images to the copy sheet simultaneously. The copy sheet is then fed to an output tray 46. This particular duplexing mechanism is well-known for monocolor reproduction, see for example, U.S. Pat. No. 4,191,465. A multicolor duplexing method is disclosed in U.S. application Ser. No. 119,370, filed Nov. 10, 1987 to Gregory P. Mahoney and Bruce R. Benwood.

The conventional commercial approach to producing three color copies of this type is to create three consecutive images of different colors and superpose them in registration to a copy sheet at a transfer station. Superposition of the images is accomplished by either attaching the copy sheet to a rotating drum or by recirculating it back through what might conventionally be termed a duplex paper path to pick up subsequent images. In any case, multiple transfer to the paper is necessary which creates registration problems between color frames. Transfer drums for such systems are generally expensive. More important, for a three color reproduction, the apparatus delivers only one-third throughput that it would deliver for monocolor copies.

In the apparatus described in FIG. 1 three color images are produced at the same rate as monocolor images. Registration need only be accomplished between the exposing stations 30, 32 and 34. The sophistication of that registration depends on the requirements of the system. To obtain the most accurate registration, encoders 16, 17 and 18 are attached to rollers 10, 11 and 12, which encoders assure the accuracy of placement of electronically controlled exposures by exposure stations 30, 32 and 34. For the greatest accuracy the rollers 10, 11 and 12 can also include sprockets which engage perforations in the member 2 to carefully control the location of the member during consecutive exposure. Each encoder would signal the angular location of its sprocket which in turn is positioned by a perforation engaging a tooth in the sprocket, which perforation is the same for comparable portions of all three images. If the images are placed in substantially different areas of the frame and if movement of the web is relatively constant, no encoder may be necessary. As an intermediate alternative suitable for most applications, one encoder can handle registration for all three exposure stations.

After the copy sheet has left the web to go to the fuser 45, the photoconductive member 2 is cleaned at cleaning station 50 for reuse, as is well-known in the art.

Obviously, if a two-color system alone is desired for a particular apparatus, the third charging station 24 exposure station 34 and toning station 44 can be eliminated. Two-color systems have particular application to high speed printers in which the primary mode of operation is monocolor, i.e., black, and the second color, usually red or blue, is used to highlight certain passages of text or give a flair to letterheads, logos, and the like. In such apparatus the first development station 40 or the second station 42 can be a larger, heavier duty development station than the other station.

A serious problem faced by the method and apparatus described with regard to FIG. 1 is that the second and third development stations have a tendency to disturb the previously applied toner, i.e., that applied by the first and second toning stations.

By far, the most common development method used in dry electrophotography is magnetic brush development. Conventionally, a magnetic brush development mechanism includes a two-component developer, one component including large magnetic carrier particles and the other smaller pigmented toner particles. The mixing of the two components triboelectrically charges them to opposite polarities. The magnetic characteristic of the carrier is used to transport the developer into close proximity with the electrostatic image in the presence of an electric field which urges the toner particles to some portion of the image. In reverse development, as used in the apparatus shown in FIG. 1, the toner particles become charged triboelectrically to a polarity the same as the charge placed on the photoconductive member 2 and therefore are attracted in the presence of a carefully controlled electric field to the discharged portions of the electrostatic image.

Prior magnetic brushes typically include soft magnetic carrier, for example, carrier that has a coercivity substantially less than 100 gauss. As such particles are subjected to a changing magnetic field their magnetism changes with the field. This permits a brush to transport the carrier in the form of long relatively static bristles through the development zone. To apply substantial toner at medium speed, the brush generally requires relative motion with respect to the electrostatic image, commonly obtained by rotating a non-magnetic sleeve in a direction opposite to the direction of the image. The bristles have a tendency to brush any prior toner image off the image area.

Certain prior art, mentioned above, has attempted to solve this problem by the use of what is commonly known as "projection" development. In this approach mono-component developer, that is, toner with or without a significant carrier is brought generally into an area associated with the image and vibrated in that area by an oscillating electric field which causes the toner to appear to "jump" across a gap between the body of developer and the image. The gap between the brush and the electrostatic image may inhibit brushing off prior toner images, but this approach is limited in the colors of toners available, the speed with which it can deposit toner and the bias control of the deposition process, especially the control of unwanted background.

However, these problems can be solved by the use of a particular magnetic brush method and apparatus, known per se, that does not have the problems of the prior art. That method is disclosed in U.S. Pat. No. 4,546,060, Miskinis et al, issued Oct. 8, 1985; U.S. Pat. No. 4,473,029, Fritz et al, issued Sept. 25, 1984; and U.S. Pat. No. 4,531,832, Kroll et al, issued July 30 1985, discussed above. According to those patents, the developer is transported through the development zone by rotating an alternating-pole magnetic core within a non-magnetic shell upon which shell the developer flows through said zone, and the developer includes hard magnetic carrier particles that are sufficiently hard that they flip or tumble as they pass through the development zone.

The invention disclosed in the patents cited above uses hard magnetic carrier particles which do not adapt magnetically to a changing field. Rather they are spun or tumbled by the field. Without intending to be limited to any technical theory of operation, it is believed that the remarkable results obtained herein are because excellent development can be obtained with these tumbling, magnetically hard carrier particles without creating bristles in the development zone that have a tendency to clean off the image.

These three patents are all incorporated by reference herein, and will be discussed with respect to FIG. 2 herein.

Figure 2:
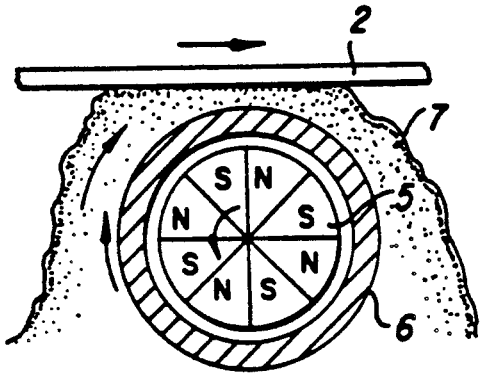
FIGS. 2 and 3 are side views generally illustrating a magnetic brush apparatus particularly usable in the electrophotographic printer shown in FIG. 1.

According to FIG. 2, a magnetic brush is illustrated which is useable in the process and apparatus illustrated in FIG. 1. A photoconductive member 2 is moving in a direction indicated by the arrow and carries an electrostatic image, not shown. The magnetic brush includes a rotatable magnetic core 5 which includes a plurality of magnets with alternating north and south poles arranged around the core periphery. A non-magnetic shell 6 is concentric with the core 5. As is well-known in the art, if the core 5 is rotated in a counterclockwise direction as shown in FIG. 2 developer 7 is driven in a direction clockwise around the non-magnetic shell 6. Similarly, if the non-magnetic shell 6 is driven in a clockwise direction as shown in FIG. 2, it has a tendency to move the developer 7 in a clockwise direction.

According to the Miskinis, Fritz and Kroll patents, such apparatus uses a developer of electrically insulative toner particles and "hard" magnetic carrier particles having high minimum coercivity when magnetically saturated. Unlike the projection toning systems suggested in the prior art or processes similar to that shown in FIG. 1, the developer disclosed in the Miskinis patent can be used with a large variety of toner colors and if the magnetic core is rotated at a relatively high velocity, for example, 1500 RPM, enough developer can be brought into operative relation with an electrostatic image to do high quality toning at high speeds. Because it is basically a two-component system the carrier itself can be used as part of the development electrode which gives greater control over background toning than in mono-component systems.

Figure 3:
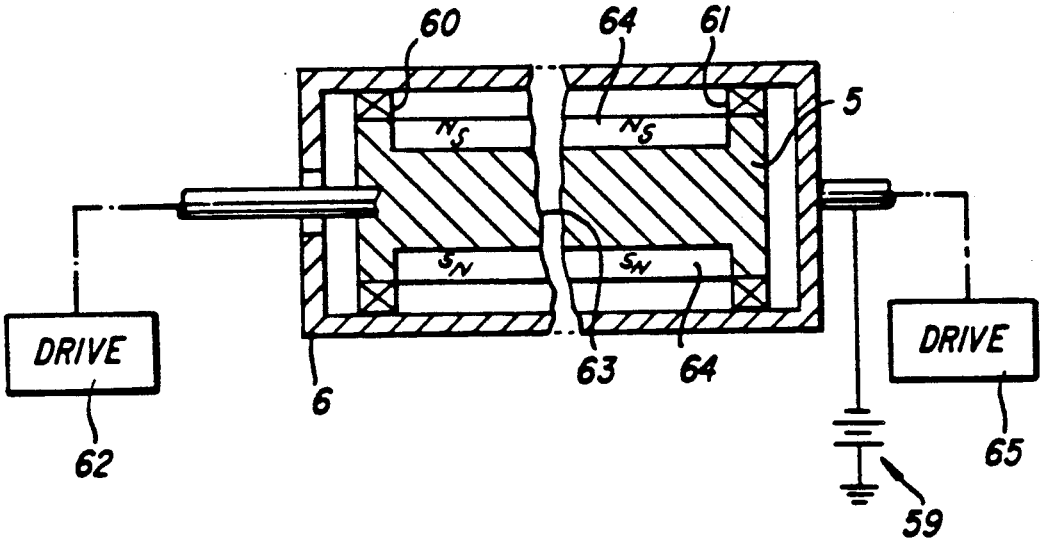

According to FIG. 3 the general constructional features of the brush shown in FIG. 2 are illustrated. More specifically the core 5 is mounted on bearings 60 and 61 for rotation as driven by a drive 62. The core includes a ferrous material 63 with a plurality of permanent magnet strips 64 located around its periphery in alternating polarity relation. The shell 6 is made of non-magnetic material such as stainless steel and is mounted for rotation and driven by a drive 65.

The characteristics of the dry developer compositions that are particularly useful in the present invention are described below and in more detail in said Miskinis et al patent. In general such developer comprises charged toner particles and oppositely charged carrier particles that contain a magnetic material which exhibits a predetermined high-minimum level of coercivity when magnetically saturated. More particularly such high minimum level of saturated coercivity is at least 100 gauss (when measured as described below) and the carrier particles can be binderless carriers (i.e., carrier particles that contain no binder or matrix material) or composite carriers (i.e., carrier particles that contain a plurality of magnetic material particles dispersed in a binder). Binderless and composite carrier particles containing magnetic materials complying with the 100 gauss minimum saturated coercivity levels are referred to herein as "hard" magnetic carrier particles. Coercivity levels in excess of 1000 gauss are preferred.

When the core is driven in one direction, the hard magnetic carrier particles tumble in a direction that causes them to be transported in the opposite direction of the shell, which shell can be roughened to assist the tumbling and transportation process. The tumbling carrier provides a "soft" brush to the electrostatic image that does not require relative movement to develop images at high speed.

Figure 4:
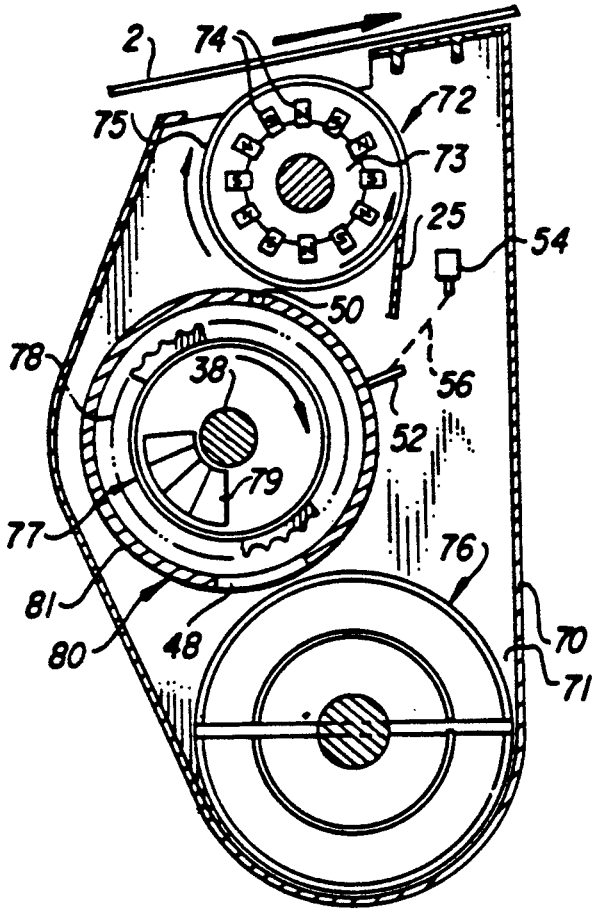
FIGS. 4 and 5 are cross sections of a preferred magnetic brush usable in the printer shown in FIG. 1.
Figure 5:
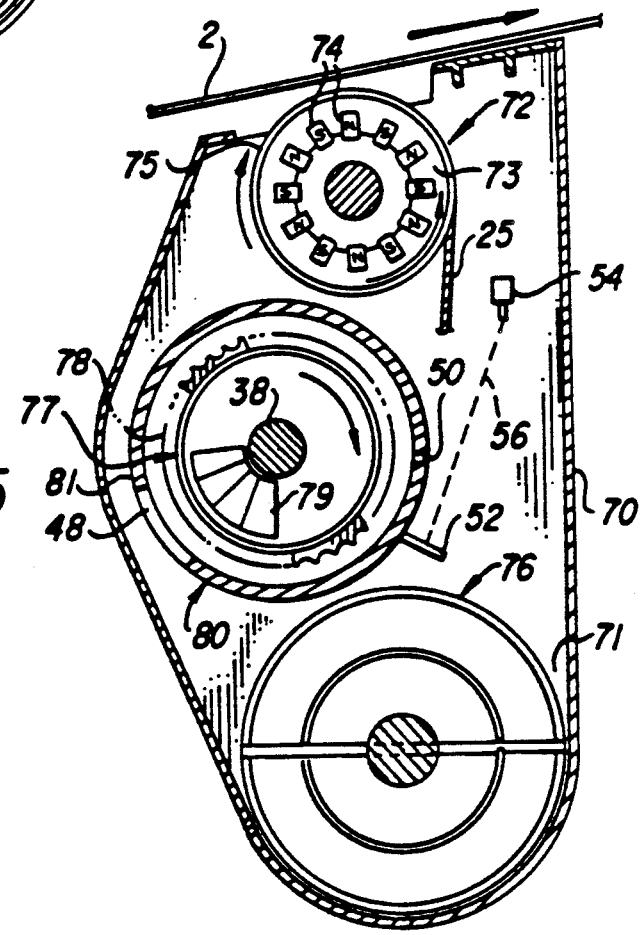

FIGS. 4 and 5 illustrate a commercial embodiment of a development station useable in the position of any of the development stations shown in FIG. 1, but particularly useable as the second development station and the third development stations 42 and 44. Photoconductive member 2 is moving from left to right as shown by the arrow in FIGS. 4 and 5. A housing 70 defines a sump 71 containing a two-component developer mix as described above. An applicator 72 includes a core 73 containing magnets 74 which core and magnets are rotatable in a counterclockwise direction as illustrated by the arrow. A cylindrical non-magnetic shell 75 surrounding the core is rotatable in a clockwise direction. The core 73 and the shell 75 cooperate as described with respect to FIGS. 2 and 3 to move developer in a clockwise direction and are driven at velocities to move the developer at substantially the same linear speed as the photoconductive member. A blade 25 engages the shell downstream of the development zone between the shell and the photoconductive member 2 to remove unused developer material from the shell and return it to the sump.

Developer in sump 71 can be mixed, agitated and triboelectrically charged by means of a ribbon blender 76.

Material from sump 71 is moved by the ribbon blender 76 not only axially in the sump but also radially outwardly so that some of the material is provided to a feeding mechanism 77. The feeding mechanism includes a cylindrical transport roller 78 which is rotatable in a clockwise direction and has an outer surface which is deeply fluted as shown in FIGS. 4 and 5. The fluted surface picks up developer from the lower portion of the feeding mechanism and transports it to the applicator 72. A magnet 79 inside transport roller 78 attracts developer to the roller 78 from the ribbon blender 76. A gating and metering mechanism 80 includes a gating tube 81 spaced from and surrounding transport roller 78 that provide an annular space for the flow of developer. Tube 81 has an elongate relatively wide slot 48 and a much narrower elongate slot 50.

Slot 48 is relatively wide so that a substantial amount of developer material from sump 71 can pass through slot 48 and enter the space between tube 81 and transport roller 78 to be transported by roller 78 to the slot 50. Slot 50 on the other hand is much narrower and meters the desired amount of development material to the applicator 72. Tube 81 is oscillated between the positions shown in FIG. 1 and FIG. 2 to control the flow of developer material to the applicator 72. Such movement can be accomplished in any suitable manner. For example, a pin 52 secured to the tube can be coupled to a solenoid 54 as shown diagrammatically at 56, so that the solenoid is effective to move the tube between these two positions. The solenoid can be controlled from a logic and control unit of the printer so that it is actuated at precisely the correct time relative to movement of images on photoconductive member 2 past the development station.

When the tube is in its FIG. 1 position slot 48 is between the ribbon blender and the magnet 79 so that developer from the sump can be driven by the ribbon blender through the slot. Such material is attracted to roller 78 by the magnet 79. The roller transports the material to the top where it is attracted toward the applicator 72 by the magnets 74 on the core 73. Thus, some of the developer will flow through the smaller slot 50 to the applicator 72.

In order to shut off the flow of developer to the applicator, the tube is rotated approximately 6 degrees from its FIG. 4 position to its FIG. 5 position. At this time the larger slot 48 is spaced from the ribbon blender and the sump so that material from the ribbon blender and sump cannot pass through the slot into the space between the tube and the roller. Also, the smaller slot 50 is spaced from the applicator 72. When slot 50 is in its FIG. 5 position, any developer material flowing through the slot from the space between the tube and roller falls under the influence of gravity back into the sump.

With the gating and metering structure described in this development station the flow of developer can be totally cut off quite abruptly without movement of the station as a whole. Thus, referring back to FIG. 1, if the apparatus shown therein is to be operated for a number of copies using only the first development station 40 to make, for example, a series of reproductions using only black toner, the gating structure can be used to prevent developer from contacting the photoconductive member at the unused development stations 42 and 44.

The embodiment shown in FIGS. 4 and 5 suggests an attractive alternative to the FIG. 1 apparatus in which the exposure station 34 and the third charging station 24 are eliminated. The exposure for the second color would then be accomplished by exposure station 32 but that color could be either of the colors carried in development stations 42 and 44 depending on which gate structure permits development.

The embodiment shown in FIGS. 4 and 5 is also described and claimed in U.S. Pat. No. 4,690,096 to Hacknauer.

Figure 6:
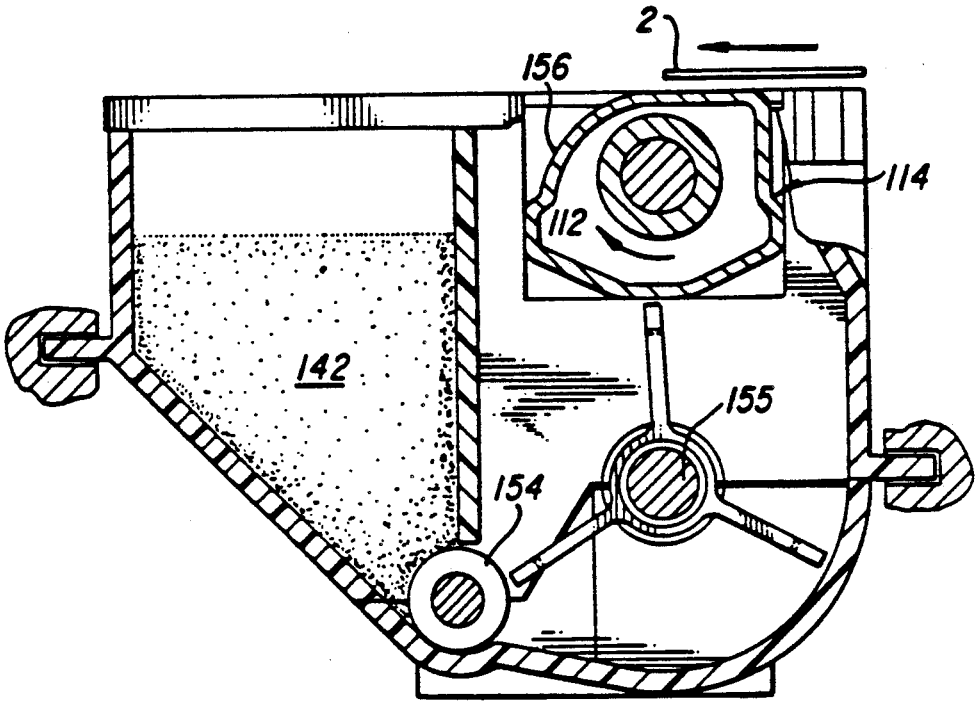
FIG. 6 is a cross section of an alternative magnetic brush usable in the printer shown in FIG. 1.

FIG. 6 shows a substantially different embodiment of a toning station useful in the method shown in FIG. 1 which is also described in U.S. Pat. No. 4,797,704 to Hill et al. According to FIG. 6, toner is kept in a toner supply 142 and is fed on demand by a driven metering roller 154 to a sump area containing a rotatably driven paddle wheel 155. An applicator 156 includes a magnetic core 112 substantially as described with regard to FIGS. 2, 3, 4 and 5 which is rotatable in a clockwise direction. A non-magnetic non-rotatable sleeve 114 controls the movement of developer from the sump up the right side, as shown in the FIG. 6, of the sleeve across a development zone adjacent the photoconductive member 2 and then down the left side of the sleeve where it leaves the influence of the magnetic core 112 and falls back into the sump. With this apparatus clockwise rotation of the magnetic core can move the developer across the development zone at substantially the same linear speed as the movement of an electrostatic image carried by a photoconductive member 2.

Referring to FIG. 3 an electrical bias is applied by a bias applying means 59 to the non-magnetic shell 6. This bias is picked to create an electric field which discourages the deposition of toner in the background areas. In reverse development, the background areas are the portions of the image area that are fully charged. For example, a charge of +600 volts is placed on the photoconductive member 2 at the first charging station 20 and an LED printhead at the first exposing station 30 dissipates image areas down to +100 volts. At the first development station 40, positively charged toner mixed with negatively charged carrier is applied to the electrostatic image under an electric field created by a bias on the non-magnetic sleeve of +500 volts. This field will encourage positively charged toner toward the less positively charged exposed areas which are at +100volts but will discourage disposition at the more positively charged background areas which are maintained at +600 volts. This is a concept well-known in the art which varies according to the parameters of the system. For that reason, depending on the toner and carrier used, the bias at the second development station may well be optimized at a different level than that of the first development station even though the polarites remain the same. Similarly, the level of charge applied at stations 20, 22 and 24 can also be varied to advantage.

The second and third charging stations 22 and 24 are necessary in the process only if the previous toning stations adversely affect the charge originally placed by charging station 20 or if a different charge is desired for the second imaging step. The development mechanism described in this invention has shown very little adverse effect on the original charge. Although it may be advantageous for highest quality work to include a small boost and leveling of the uniform charge, particularly to areas containing deposited toners, it does not appear to be necessary for most applications.

Although the process has been described with respect to reverse development systems in which each consecutive image does not overlap its previous images, the invention in its broadest form applies to any process in which an electrostatic image is to be toned in the same general area containing a first toner image, whether or not the second image overlaps with the first, whether or not the second image is to be toned with ordinary positive development and whether or not the second image is of a different color than the first. (One, for example, could be magnetic and the other not).

Note that the apparatus shown in FIG. 1 is capable of creating multicolor duplex output at full machine speed with the duplex images being formed in their natural order. This makes this particular apparatus particularly useful as a high speed color printer.

The invention has been described in detail with particular reference to a preferred embodiment thereof, but it will be understood that variations and modifications can be effected within the spirit and scope of the invention as described hereinabove and as defined in the appended claims.

We claim:

1. A method of developing an electrostatic image on an image area of an image bearing surface, which image area already contains an unfixed first toner image without substantially disturbing the first toner image, said method comprising:

moving said image bearing surface containing said unfixed first toner image and said electrostatic image through a development zone, and rotating a magnetic core that includes a plurality of alternating magnetic pole portions that are arranged around the core periphery within a non-magnetic shell to move developer including hard magnetic carrier particles, said particles being sufficiently hard to flip or tumble as they pass through said development zone, and electrically insulative toner particles along the surface of said shell through said development zone into contact with said image bearing surface to develop the electrostatic image.

2. The method according to claim 1 wherein said hard magnetic carrier particles have a coercivity sufficient to be tumbled through said development zone in response to rotation of said magnetic core.

3. The method according to claim 2 wherein said hard magnetic carrier particles have a coercivity of at least 100 gauss when magnetically saturated.

4. The method according to claim 2 wherein said hard magnetic carrier particles have a coercivity of at least 1000 gauss when magnetically saturated.

5. A method of developing an electrostatic image on an image area of an image bearing surface, which image area already contains an unfixed first toner image without substantially disturbing the first toner image, said method comprising:

moving said image area containing said unfixed first toner image and said electrostatic image through a development zone at a predetermined velocity, and transporting developer, including hard magnetic carrier particles, said particles being sufficiently hard to flip or tumble as they pass through said development zone, and electrically insulative toner particles, through said development zone into contact with the electrostatic image at a velocity approximating that of said electrostatic image.

6. A multicolor electrophotographic reproduction method of the type including the steps of creating a first electrostatic image on an image receiving area of a photoconductive member, said image having reduced levels of charge compared to the rest of said area, applying finely divided toner of a first color to said image to create a first toner image, creating a second electrostatic image on said image receiving area, said second electrostatic image having reduced levels of charge compared to the rest of said area, and without fixing said first toner image applying finely divided toner of a second color to said second electrostatic image to form a second toner image without substantially disturbing the first toner image, characterized in that said step of applying toner of a second color includes the steps of moving said second electrostatic image through a development zone at a predetermined velocity, and transporting developer, including hard magnetic carrier particles, said particles being sufficiently hard to flip or tumble as they pass through said development zone, and colored toner particles, through said development zone and into contact with said photoconductive member at a velocity approximating that of said photoconductive member to develop said second electrostatic image.

7. A multicolor electrophotographic reproduction method of the type including the steps of creating a first electrostatic image on an image receiving area of a photoconductive member, said image having reduced levels of charge compared to the rest of said area, applying finely divided toner of a first color to said image to create a first toner image, creating a second electrostatic image on said image receiving area, said second electrostatic image having reduced levels of charge compared to the rest of said area, and without fixing said first toner image, applying finely divided toner of a second color to said second electrostatic image to form a second toner image without substantially disturbing the first toner image, characterized in that said step of applying toner of a second color includes the steps of moving said second electrostatic image through a development zone, and transporting developer, including hard magnetic carrier particles and electrically insulative toner particles, said particles being sufficiently hard to flip or tumble as they pass through said development zone, through said development zone in contact with the second electrostatic image by rotating an alternating-pole magnetic core within a non-magnetic shell upon which shell the developer flows through said development zone.

8. The method according to claim 7 further including the step of rotating said non-magnetic shell in a direction opposite to the rotation of said core, the combined rotations of said core and shell contributing to the movement of said developer through the development zone at substantially the velocity of said second electrostatic image.

9. The method according to claim 7 further including the step of applying at said development zone an electric field that deters development of the portions of said image receiving area that do not contain reduced levels of charge.

10. The method according to claim 7 wherein said core is rotated in a direction opposite to the direction of movement of the developer.

11. The method according to claim 9 wherein said shell moves in the same direction as the electrostatic image and the developer in the development zone.

12. A multicolor reproduction method of the type including the steps of creating a first electrostatic image on an image receiving area of a photoconductive member, applying finely divided toner of a first color to said image to create a first toner image, creating a second electrostatic image on said image receiving area, without fixing said first toner image, applying finely divided toner of a second color to said second electrostatic image to form a second toner image without substantially disturbing the first toner image, characterized in that said step of applying toner of a second color includes the steps of moving said second electrostatic image through a development zone at a predetermined velocity, and transporting developer, including hard magnetic carrier particles, said particles being sufficiently hard to flip or tumble as they pass through said development zone, and electrically insulative toner particles, through said development zone into contact with the second electrostatic image at a velocity approximating that of said second electrostatic image by rotating an alternating-pole magnetic core within a non-magnetic shell upon which shell the developer flows through said development zone and into contact with said second electrostatic image.

13. A multicolor reproduction method of the type including the steps of applying a uniform electrostatic charge of a first polarity to the surface of a moving photoconductive member, imagewise exposing said charged member to create a first pattern of charged and relatively discharged portions, applying finely divided toner of a first color and of said first polarity to said pattern to create a first toner image adhering to the relatively discharged portions, again imagewise exposing said charged member to create a second pattern of relatively discharged portions in the portions that were charged in the first pattern, without fixing said first toner image, applying finely divided toner of a second color and said first polarity to said second pattern to create a second toner image adhering to the second relatively discharged portions without substantially disturbing the first toner image to create a multicolor toner image, characterized in that said step of applying toner of a second color includes the steps of moving said photoconductive member through a development zone, and transporting developer, including hard magnetic carrier particles, said particles being sufficiently hard to flip or tumble as they pass through said development zone, and electrically insulative toner particles, through said development zone into contact with the second electrostatic image by rotating an alternating-pole magnetic core within a non-magnetic shell upon which shell the developer flows through said development zone and into contact with said second electrostatic image.

14. The method according to claim 13 including the step of applying a uniform electrostatic charge of a first polarity to said member between the step of applying toner of a first color and the step of again imagewise exposing.

15. The method according to claim 13 further including the step of transferring the first and second toner images simultaneously to a receiving surface.

16. The method according to claim 13 wherein said steps are repeated to form a second multicolor image on said member and said first and second color images are transferred to one surface of a copy sheet and said second multicolor image is transferred to the opposite surface of the same copy sheet.

17. The method according to claim 16 wherein said transferring steps are carried out without fixing the images until both images are transferred and said images are then fixed simultaneously.

18. The method according to claim 16 wherein said first multicolor image is transferred at a first transfer station and said second multicolor image is transferred at a second transfer station.

* * * * *